United States Patent [19]

Riceman

[11] Patent Number: 4,899,019

[45] Date of Patent: Feb. 6, 1990

[54] SAFETY COVER FOR ELECTRICAL RECEPTACLES

[75] Inventor: Robert G. Riceman, Roswell, Ga.

[73] Assignee: Donald J. Scheer, Atlanta, Ga.

[21] Appl. No.: 23,685

[22] Filed: Mar. 9, 1987

[51] Int. Cl.[4] ..... H01R 13/447

[52] U.S. Cl. ..... 174/67; 439/142

[58] Field of Search ..... 74/66, 67; 220/241, 220/242; 439/136, 142

[56] References Cited

U.S. PATENT DOCUMENTS

| | | | |
|---|---|---|---|
| 2,526,606 | 10/1950 | Gregg | 174/67 |
| 2,880,264 | 3/1959 | Ruskin | 174/67 |
| 2,916,733 | 12/1959 | Hirsch | 174/67 X |
| 4,070,078 | 1/1978 | Chrones | 174/67 X |
| 4,603,932 | 8/1986 | Heverly | 174/67 X |
| 4,652,696 | 3/1987 | Winnick | 174/67 |

*Primary Examiner*—Arthur T. Grimley
*Assistant Examiner*—David A. Tone
*Attorney, Agent, or Firm*—James A. Hinkle

[57] ABSTRACT

A safety cover for preventing access to an electrical receptacle while the receptacle contains a plug includes a receiving plate and a box-shaped cover assembly which can be locked over the receiving plate. The cover assembly has a plurality of locking flanges each of which can be independently depressed and thereby moved in and out of means for receiving locking flanges located on the receiving plate. To remove the cover assembly from the receiving plate, it is necessary to simultaneously depress each locking flange. Flange-releasing means are positioned on the cover assembly in a manner that renders small children incapable of reaching and depressing all the flanges simultaneously.

10 Claims, 3 Drawing Sheets

SAFETY COVER FOR ELECTRICAL RECEPTACLES

BACKGROUND OF THE INVENTION

This invention relates to a safety cover for an electrical receptacle, and more particularly, to a combination receiving-plate and housing member connected by hinging means and capable of being locked so as to prevent access by young children or the like. The invention is designed so that an electrical plug may be plugged into the electrical receptacle while the housing member is in locked position.

Electrical wall receptacles present much danger to young children and others who make accidental contact with such current-carrying outlets. Compounding this danger is the fact that electrical cords often suffer wear at the area where the cord meets its electrical plug, this is particularly dangerous when the receptacle or plug is exposed to water, as with an outdoor receptacle.

Safety guard designed to prevent unauthorized access to electrical receptacles have been known. However, these have consisted solely of a cover and receiving plate, and have ignored the need for preventing access by children to the receptacle when it contains a plug. Similarly, guards designed to protect receptacles from the elements have ignored the need for maintaining such protection when a plug is in the receptacle.

There exists a need, therefore, for a safety cover which prevents unauthorized access to an electrical receptacle while a plug is in the outlet.

There exists a further need for such a safety cover which also protects the receptacle from the elements while a plug is in the outlet.

SUMMARY OF THE INVENTION

According to the present invention, a receiving plate having outlet holes is affixed over an electrical receptacle so as to allow an electrical plug to be inserted into the outlet. A box-shaped cover assembly is hingedly connected to the receiving plate, thereby enabling the assembly to be closed over the receptacle while the plug is in the outlet. The electrical cord, necessarily attached to the plug, passes through a small hole located on the cover assembly and to its corresponding electrical device.

The cover assembly has extending from it towards the receiving plate a plurality of locking flanges, each capable of being moved slightly toward the interior of the assembly. The receiving plate has means for receiving the locking flanges, thereby enabling the cover assembly to be interlocked with the receiving plate. The assembly is unlocked and removed from the plate by simultaneously depressing each locking flange so that the flanges move out of the means for receiving locking flanges.

The cover assembly can be comprised of a box-shaped outer housing member and an attached inner housing member. The outer housing member has a hinging means on one side wall, which is hingedly connected to the receiving plate, a second side wall, a top wall, a bottom wall, and a back wall.

The inner housing member is preferably comprised of three independently, depressable platforms. Each platform may be connected at one end to a common inner housing member back wall, or may be individually attached to the outerhousing member, and each has a locking flange at its distal end. The inner housing member is of a size sufficient to fit securely into the outer housing member such that the inner housing member back wall contacts and is affixed to the back wall of the outer housing member. Also, each platform lies freely adjacent to an unhinged wall of the outer housing member, and the length of each platform is such that each locking flange extends beyond its adjacent outer housing member wall. It is these exposed locking flanges that interlock with the means for receiving locking flanges to lock the cover assembly to the receiving plate.

Each platform has a raised button on its surface adjacent to its corresponding outer housing member wall. Likewise, each corresponding outer housing member wall has a buttonhole through which the button extends. Pushing down on the button will cause the platform to be depressed, thereby removing the flange from the means for receiving locking flanges. To unlock and remove the cover assembly from the receiving plate, it is necessary to simultaneously push each button so as to release all the locking flanges of the device.

It can be seen, therefore, that by locating the buttons of the device in positions which prohibit simultaneous depression, unauthorized access is denied. This is true, for example, in the case of children, whose hands are typically too small to reach and depress buttons located on opposite ends of the cover assembly. The presence of a third button, located on a side wall between the opposite ends, further adds to the difficulty of opening.

It is an object of this invention, therefore, to provide a safety cover which denies unauthorized access by small children to an electrical receptacle.

It is another object of this invention to provide a safety cover which denies access by small children to an electrical receptacle when the receptacle contains a plug.

It is a still further object of this invention to provide a safety cover which denies access by the elements when the receptacle contains a plug.

DETAILED DESCRIPTION OF THE DRAWINGS

Figure 1:
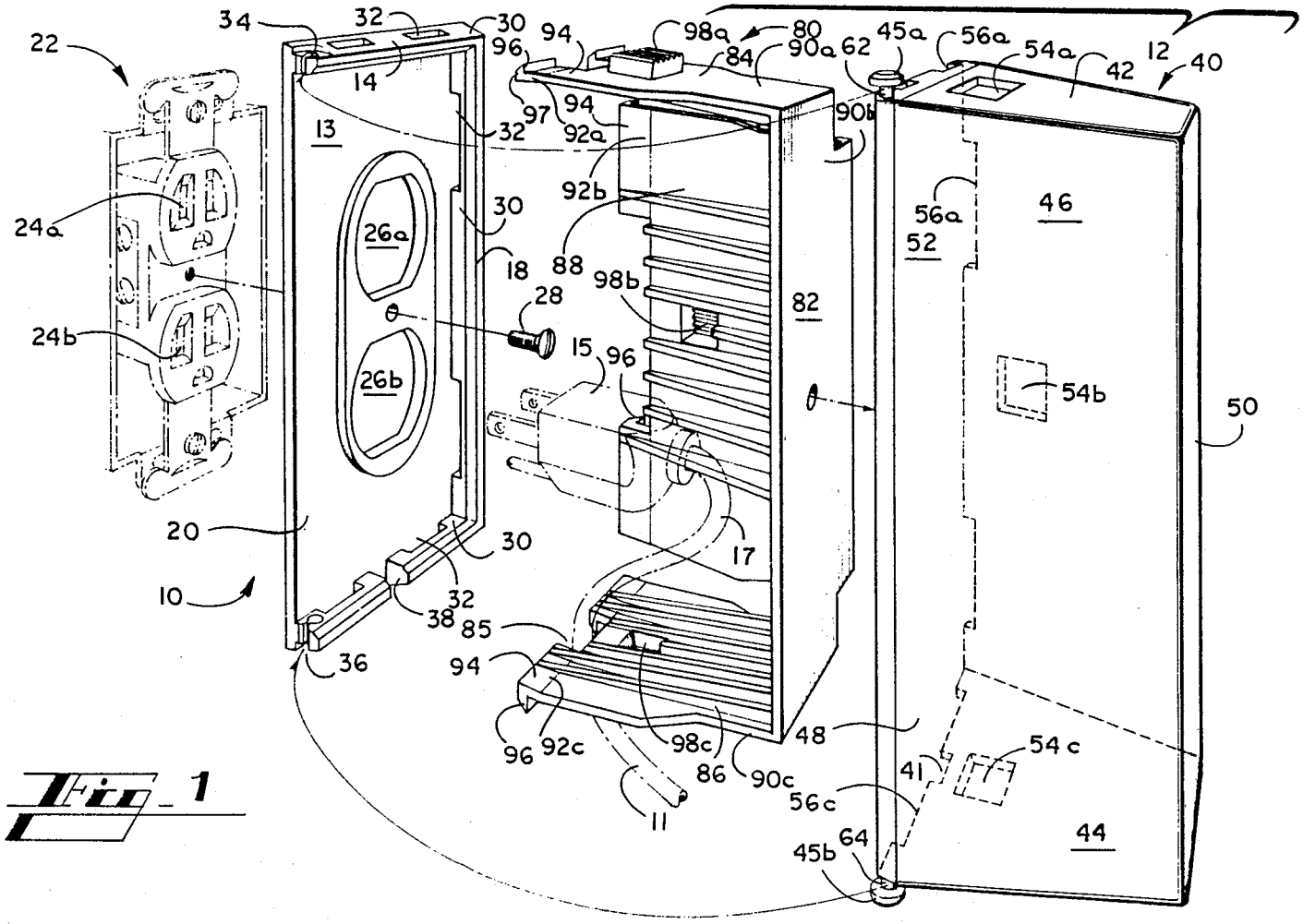
FIG. 1 shows an exploded perspective view of the safety cover of the present invention.

Referring to FIG. 1, a receiving plate 10 is provided for receiving a covering assembly 12, the assembly 12 being comprised of an outer housing member 40 and an inner housing member 80.

The receiving plate 10 is preferably square shaped, having a face 13, a top edge 14, a bottom edge 16, a first side edge 18, and a second side edge 20. The plate 10 is designed to fit over a standard electrical receptacle 22, which typically has a pair of electrical outlets 24*a, b*. The plate 10 has a pair of outlet holes 26*a, b*. The plate 10 may be attached to the receptacle 22 by standard means, including fastening with a screw 28.

The receiving plate 10 has, along its top edge 14, its bottom edge 16, and its first side edge 18, means for receiving a locking flange 94 on the inner housing member 80. These means may be comprised of a raised flange 30 having through it a locking flange receiving hole 32.

Figure 2:
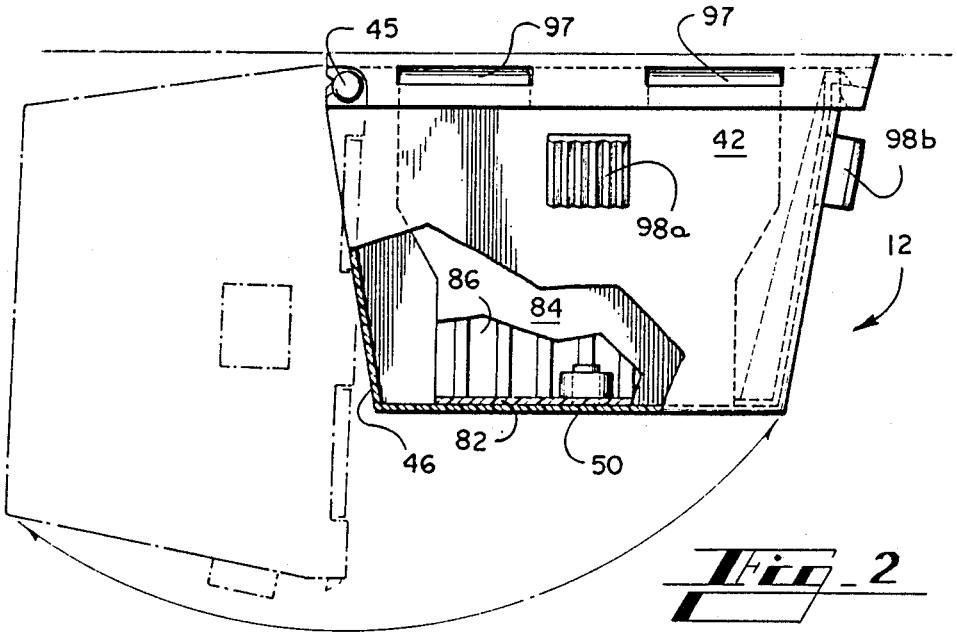
FIG. 2 shows a top view of the safety cover of the present invention in both locked and opened positions.

Means for hingingly attaching the cover assembly 12 along the second side edge 20 of the plate 10 is also provided. This allows the cover assembly 12 to be closed over the receptacle 22 or swung open to allow access to the receptacle, as shown in FIG. 2. This may be comprised of a first hinge receiving groove 34 located on the raised flange 30 of the top edge 14 adjacent to the second side edge 20, and a second hinge receiving groove 36 located on the raised flange 30 of the bottom edge 16 opposite the first hinge receiving groove 34. A pair of connecting hinges 45*a,b* located on the outer housing member 40 is provided to fit into the grooves 34 and 36, and thereby hingingly attach the cover assembly 12 to the receiving plate 10.

The outer housing member 40 is of a box like shape, and has five walls: a top wall 42, a bottom wall 44 opposite the top wall 42, a first side wall 46, a second side wall 48 opposite the first side wall 46, and a back wall 50. Opposite the back wall 50 is a first outer housing member opening 52 which fits over the face 13 of the receiving plate 10 when the cover assembly 12 is in locked position. Each wall 42, 44, 46, 48 and 50 is of a length and width sufficient to provide a housing 40 of size great enough to be occupied by a standard electrical plug 15 and to fit over the face 13 of the receiving plate 10.

Each of the top wall 42, the bottom wall 44 and the first side wall 46 of the outer housing member 40 has a button hole 54*a,b,c*. Also, each of the top wall 42, the bottom wall 44, and the first side wall 46 have a flange groove 56*a,b,c* through which a hooking means 96 of a locking flange of the inner housing member 80 may extend. Also provided on member 40 are hinging means. This may consist of a pair of connecting hinges 62 and 64 extending perpendicular to the top wall 42 and the bottom wall 44, and capable of inserting into the grooves 34 and 36 of the receiving plate 10. A cap 45*a, b* on each hinge 62 and 64 maintains each hinge 62 and 64 in its corresponding groove 34 and 36.

The inner housing member 80 is designed to fit securely inside the outer housing member 40 to form the cover assembly. The inner housing member 80 is comprised of an inner housing member back wall 82, and three platforms: a top platform 84, a bottom platform 86, and a side platform 88. When assembled, the back wall 82 of the inner housing member 80 will be fastened to the interior of the back wall 50 of the outer housing member 40. Correspondingly, the top platform 84, the bottom platform 86 and the side platform 88 of the inner housing member 80 will abut the interior portions of the top wall 42, bottom wall 44, and first side wall 46, respectively, of the outer housing member 40. Each platform 84, 86 and 88 is attached at one end 90*a, b* and *c* to the inner housing member back wall 82, and is unattached at the remaining three sides.

Figure 4:
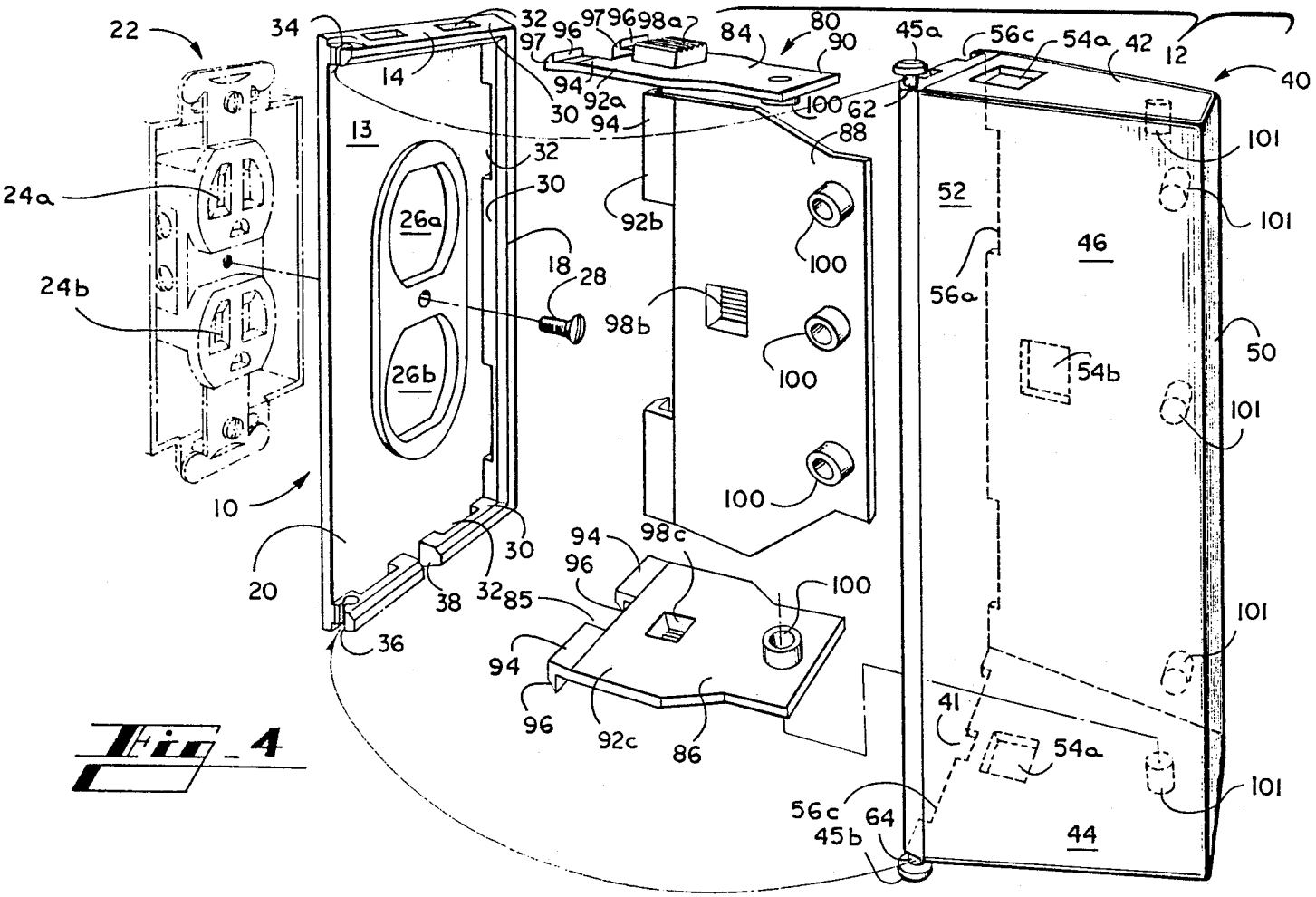
FIG. 4 shows an exploded perspective view of the second embodiment of the safety cover having unconnected platforms.

In the second embodiment, as shown in FIG. 4, each platform 84, 86 and 88 may be separate and individually attached to the outer housing member 40, in which case the inner housing member backwall 82 may be omitted. Such attachment may be achieved by means of pin joint 100 and pins 101 connecting means, or by any other attachment means. In either embodiment, the platforms 84, 86 and 88 may be depressed slightly inward toward the interior space of the inner housing member 80.

Figure 3:
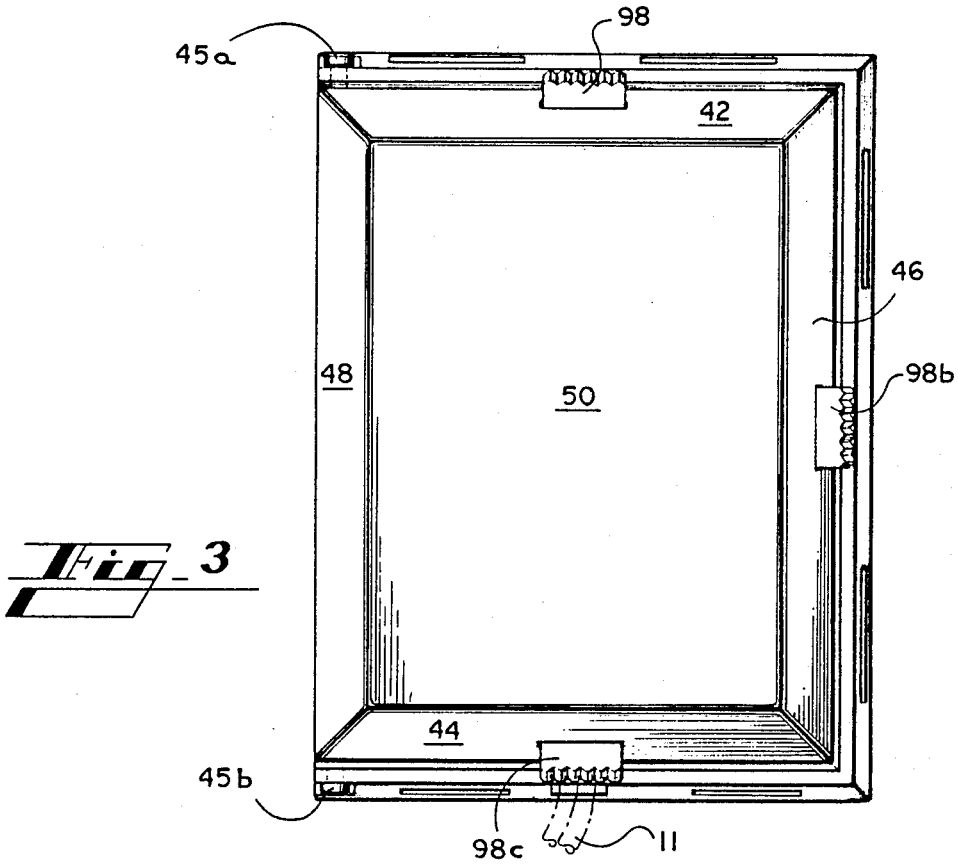
FIG. 3 is a front plan view of the safety cover of the present invention.

Located at the distal end 92*a, b* and *c* of each platform 84, 86 and 88 are locking flanges 94, preferably two in number. The locking flanges 94 extend beyond the walls 42, 44 and 46 of the outer housing member through flange grooves 56*a,b,c,* and have locking flange hooking means 96 at their distal ends. The hooking means 96 are capable of being inserted into the receiving holes 32 of the receiving plate 10, thereby holding the cover assembly 12 in locked position with the receiving plate 10 when closed as shown in FIG. 3. A transverse wall 97 located on the side of the hooking means 96 contacting the raised flange 30 enables the means 96 to be easily slid into the receiving hole 32.

Each platform 84, 86 and 88 has a push button 98*a,b,c* extending outwardly from its exterior portion and located in a position which causes the button 98 to protrude through the button hole 54 of a corresponding outer housing member wall 42, 44 and 46. Therefore, the button 98*a* of the top platform 84 will protrude through the buttonhole 54*a* of the outer housing member wall 42; the button 98*b* of the side platform 88 will protrude through the buttonhole 54*b* of the first wall 46, and the button 98*c* of the bottom platform 86 will protrude through the buttonhole 54*c* of the bottom wall 44. The pushing of a button 54 causes the inward depression of its attached platform 84, 86 or 88, and in turn causes a hooking means 96 to be removed from a flange receiving hole 32. When all locking flanges 94 are simultaneously removed from the means for receiving locking flanges, the cover assembly 12 can be swung along its hinged side and brought to open position, and the plug 15 and receptacle 22 exposed.

The dimensions of the cover assembly 12 allows the apparatus to cover a receptacle while a plug 15 is inserted into an outlet 24*a,b*. A receiving plate cord groove 38 located on the bottom edge 16 of the receiving plate 10, an inner housing member cord groove 85 located on the bottom platform 86 of the inner housing member 80, and an outer housing member cord groove 41 located on the bottom wall 44 of the outer housing member 40 all align to form a passage through which an electrical cord 17 attached to a plug can be passed.

It is clear, therefore, that an appliance or other electrically operated device can be safely plugged into an outlet without the fear that a small child or the elements may gain access. Only a person having a hand of size large enough to depress all three buttons simultaneously can gain access.

What is claimed is:

1. A safety cover for an electrical receptacle comprising:

(a) a receiving plate capable of being affixed to an electrical receptacle for lockingly receiving a cover assembly;

(b) a cover assembly having at least one pair of opposite walls for covering said receptacle, said cover assembly comprised of an outer housing member and an inner housing member having a plurality of locking means extending outwardly beyond said outer housing member toward said receiving plate and located within and affixed to said outer housing member; and (c) a plurality of individually operated locking means for locking said cover assembly to said receiving plate and unlocking said cover assembly from said receiving plate, said locking means positioned on said cover assembly in such a manner as to be incapable of simultaneous operation by a hand below a predetermined size and each said locking means comprised of:

(i) a depressable locking flange extending from said cover assembly;

(ii) a locking flange receiving means located on said receiving plate for receiving and holding said locking flange; and (iii) means for depressing said locking flange into and out of locked position with said receiving means.

2. The safety cover of claim 1, wherein said cover assembly is comprised of a top surface, a bottom surface opposite said top surface, a pair of side surfaces, and a back surface connected so as to form a box-shaped structure of size capable of covering an electrical receptacle containing a plug.

3. The safety cover of claim 2, wherein said cover assembly includes a first locking means located on said top surface and a second locking means located on said bottom surface.

4. The safety cover of claim 3, wherein said cover assembly includes a third locking means located on one of said side surfaces.

5. The safety cover of claim 1, wherein said locking means is further characterized by:

(a) said locking flange having a hooking means located at its distal end; and (b) said locking flange receiving means having a receiving hole for receiving and holding said hooking means.

6. The safety cover of claim 5, wherein said receiving hole of said receiving plate is of approximately the same size as said hooking means so that the exposure of said locking means is limited to said hooking means.

7. The safety cover of claim 1, further characterized by said outer housing member comprising a top wall, a bottom wall opposite said top wall, a first side wall, a second side wall, and a back wall connected so as to form a box-like structure capable of covering said receptacle; and said inner housing member being comprised of a top platform freely adjacent to said outer housing member top wall, a bottom platform freely adjacent to said outer housing member bottom wall, and a back platform affixed to said outer housing member back wall and connecting said top platform and said bottom platform.

8. The safety cover of claim 7, wherein said inner housing means further comprises a side platform freely adjacent to one of said outer housing member side walls and connected to said back platform.

9. The safety cover of claim 8, wherein said cover assembly is hingedly attached to said receiving plate along an outer housing member side wall having no locking means.

10. The safety cover of claim 1, further characterized by:

said means for depressing said locking flange comprising a button located on said platform which causes said locking flange to be depressed when applied with downward pressure; said button extending through a hole located on said outer housing member adjacent to said platform.

* * * * *